US007182678B2

(12) United States Patent
Keska

(10) Patent No.: US 7,182,678 B2
(45) Date of Patent: Feb. 27, 2007

(54) CLAMPING DEVICE FOR THE EXACT MANUAL RESHARPENING OF KNIFE BLADES ON A WHETSTONE

(76) Inventor: Woitek Keska, Schneidling 1, 49134 Wallenhorst (DE)

( * ) Notice: Subject to any disclaimer, the term of this patent is extended or adjusted under 35 U.S.C. 154(b) by 0 days.

(21) Appl. No.: 11/334,720

(22) Filed: Jan. 18, 2006

(65) Prior Publication Data

US 2006/0166614 A1 Jul. 27, 2006

(30) Foreign Application Priority Data

Jan. 22, 2005 (DE) ..... 10 2005 003 090

(51) Int. Cl.
*B24B 19/00* (2006.01)

(52) U.S. Cl. ..... 451/367; 451/378; 451/391

(58) Field of Classification Search ..... 451/365, 451/367, 370, 371, 377, 378, 386, 320–322, 451/557, 558

See application file for complete search history.

(56) References Cited

U.S. PATENT DOCUMENTS 2,437,495 A * 3/1948 Anderson ..... 451/371
3,800,632 A 4/1974 Juranitch
3,924,360 A * 12/1975 Haile et al. ..... 451/371
5,363,602 A * 11/1994 Anthon et al. ..... 451/540
5,472,375 A * 12/1995 Pugh ..... 451/367
6,030,281 A 2/2000 Cozzini et al.
6,227,958 B1 * 5/2001 Neuberg ..... 451/367

FOREIGN PATENT DOCUMENTS

DE 7418952 5/1974

* cited by examiner

*Primary Examiner*—Dung Van Nguyen
(74) *Attorney, Agent, or Firm*—McGlew & Tuttle, PC

(57) ABSTRACT

A clamping device is provided for the exact manual resharpening of knife blades (6) on a whetstone (5). The knife blade (6) is mounted in the clamping device (9) and at least one support contour (2, 14, 14*a*) of the clamping device (9) is designed such that it is congruent with the contour of the cutting edge of the knife blade (6) or that it extends equidistantly from the contour of the cutting edge of the knife blade (6). The present invention is characterized in that the support contour (2, 14, 14*a*) has an end piece provided with an arch (14) or an end piece provided with a radius (14*a*).

19 Claims, 5 Drawing Sheets

14
9

11
13
14
15
12

3
14

14
3
Radius
Radius

CLAMPING DEVICE FOR THE EXACT MANUAL RESHARPENING OF KNIFE BLADES ON A WHETSTONE

CROSS REFERENCE TO RELATED APPLICATIONS

This application claims the benefit of priority under 35 U.S.C. § 119 of German Patent Application DE 10 2005 003 090.4 filed Jan. 22, 2005, the entire contents of which are incorporated herein by reference.

FIELD OF THE INVENTION

Knives are subject to wear of the knife blade due to use, so that the blade must resharpened at regular intervals. Whetstones, with which the blade of the knife can be processed, are available for this purpose in specialist shops. During sharpening, the cutting surface of the knife blade should be held possibly at a constant angle (setting angle) in relation to the surface of the whetstone. This is difficult during manual sharpening and it therefore frequently leads to unsatisfactory results. The setting angle corresponds to half the blade angle, which is determined by the two cutting surfaces.

BACKGROUND OF THE INVENTION

U.S. Pat. No. 3,800,632 pertains to a clamping device for the exact manual resharpening of knife blades on a whetstone, in which the knife blade is mounted in the clamping device and at least one support contour of the clamping device is designed such that it is congruent with the contour of the cutting edge of the knife blade or that it extends equidistantly from the contour of the cutting edge of the knife blade. However, according to the disclosure content of the document, the constant distance between the support contour and the contour of the cutting edge of the knife blade is not given over the entire length of the knife blade, but in some sections only.

The drawback of this embodiment is consequently that the sharpening of the cutting edge of the knife blade up to the tip of the knife is difficult to carry out and the result of sharpening is thus qualitatively unsatisfactory and is not constant.

A highly complicated embodiment of a clamping device for the exact manual resharpening of knife blades on a whetstone is disclosed in DE 7,418,952 U1, in which the knife blade is held in a frame and is guided with this frame over the sharpening surface. Rollers are provided to support the movement. This clamping device is suitable for sharpening straight blades only.

U.S. Pat. No. 6,030,281 shows a highly complicated embodiment of a clamping device for the exact manual resharpening of knife blades on a whetstone. This device is likewise suitable for straight blades only.

SUMMARY OF THE INVENTION

The basic object of the present invention is to provide a clamping device for sharpening the cutting edge of a knife, which clamping device makes possible the uniform sharpening of the knife blade over the entire length thereof up to the tip of the knife, has a simple design and can be manufactured at low cost.

According to the invention, a clamping device is provided for the exact manual resharpening of a knife blade on a whetstone. The knife blade is received in the clamping device. The clamping device has at least one support contour designed such that it is congruent with the contour of the cutting edge of the knife blade or that it extends equidistantly from the cutting edge contour of the knife blade. The support contour has an end piece provided with an arch or an end piece provided with a radius.

The clamping device may have at least two brackets for the clamping support of the knife blade. The brackets may have a support contour with a U-shaped cross section for inserting the knife blade. A back of the knife blade may be inserted into the clamping device to the ground or base (contact edge) of the U-shaped support contour. The clamping action of the brackets may be supported or can be achieved by a screw connection passing through same.

The clamping device as a whole is made in one piece of a plastic. The plastic may be elastic.

The clamping device can be shortened for adaptation to the length of the knife blade.

The clamping device may have a plurality of separable areas with reduced cross section in the sense of predetermined breaking points.

A constant cutting angle or setting angle is guaranteed by the clamping device according to the present invention during the sharpening of the cutting edge of a knife blade. The sharpening of a knife is thus simple and inexpensive. The clamping device to be used for sharpening can be supplied together with the knife at the time of purchase. It can also be guaranteed as a result that an exactly fitting clamping device is available for each knife blade.

Knife blades with curved cutting edge contours can also be sharpened exactly and up to the tip of the knife with the clamping device. A constantly optimal sharpening result is obtained over the entire length of the cutting edge. The clamping device is, moreover, of an extremely simple design and can therefore be manufactured at low cost.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figures 1A, 1B, 1C, 1D:
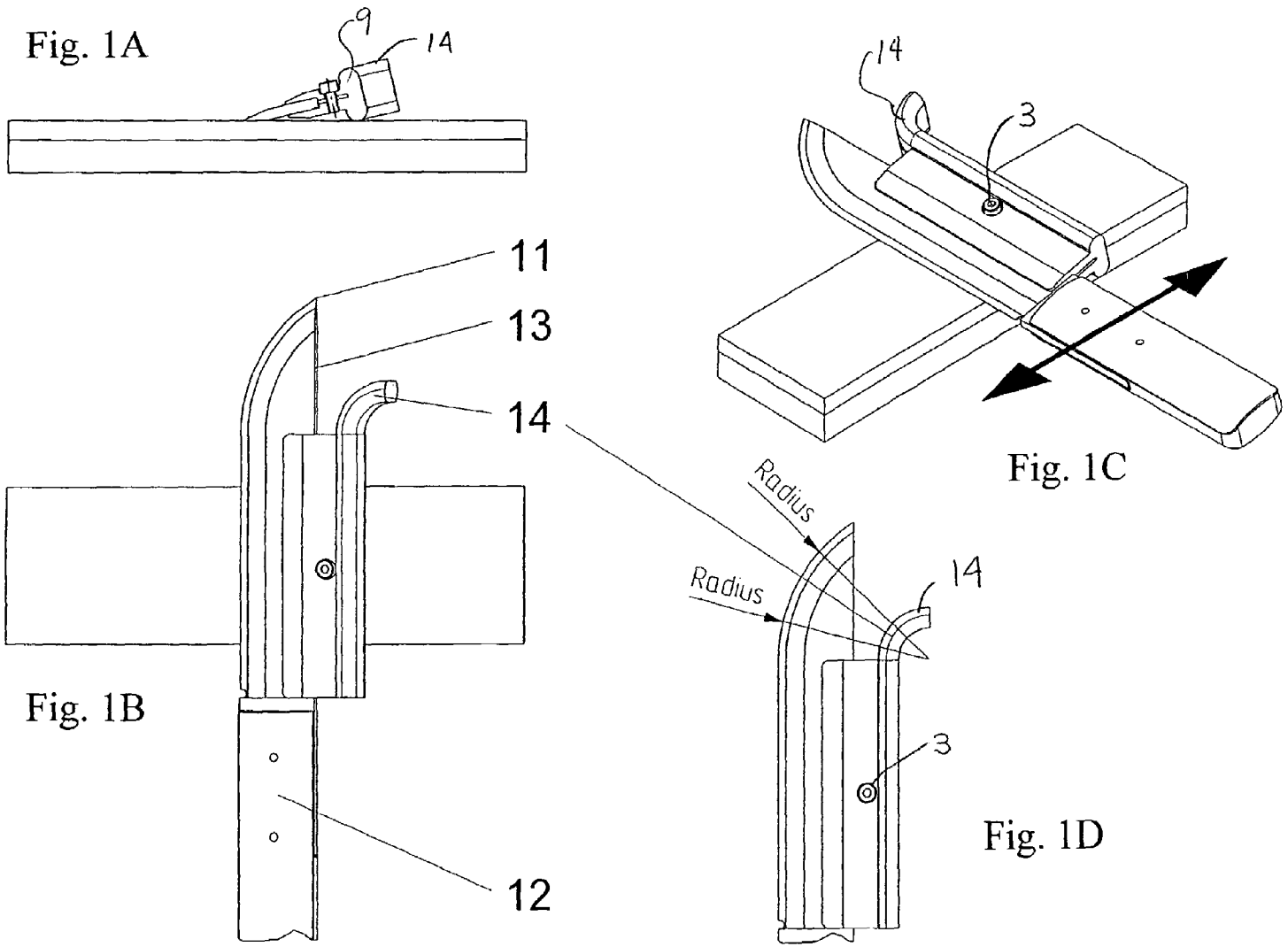
FIG. 1A is a side view of a clamping device according to a first embodiment of the invention, showing the knife blade in a clamped state.
FIG. 1B is a top view of the clamping device according to the first embodiment of the invention, showing the knife in a clamped state.
FIG. 1C is a top right perspective view of the clamping device according to the first embodiment of the invention, showing the knife in a clamped state.
FIG. 1D is a top view of the clamping device according to the first embodiment of the invention, showing the knife in a clamped state and showing the relationship between radius of the knife and end piece provided with an arch.
Figure 2C:
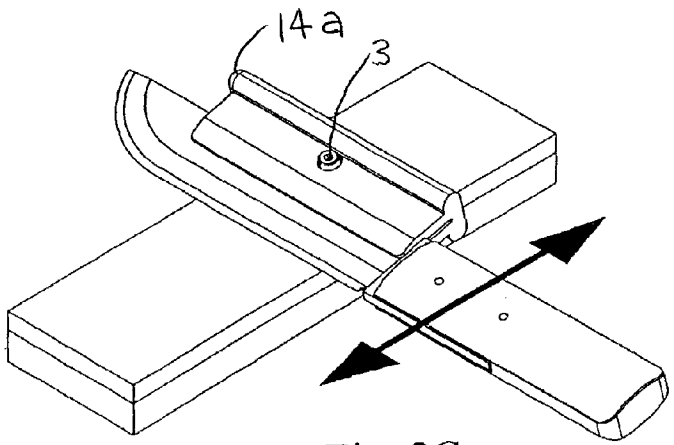
FIG. 2C is a top right perspective view of the clamping device according to the second embodiment of the invention, showing the knife in a clamped state.
Figure 2D:
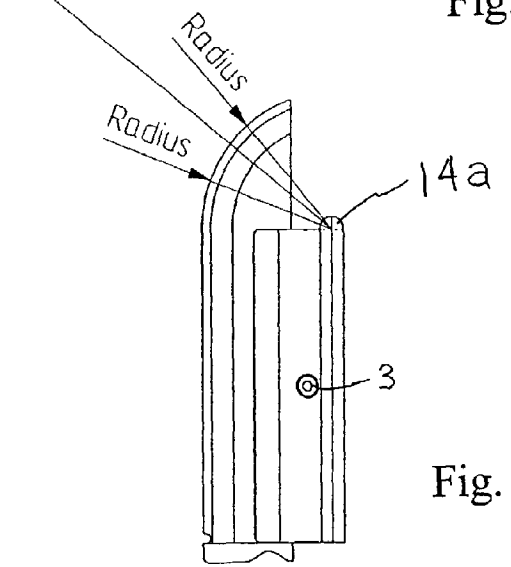
FIG. 2D is a top view of the clamping device according to the second embodiment of the invention, showing the knife in a clamped state and showing the relationship between radius of the knife and end piece provided with a radius.
Figure 2A:
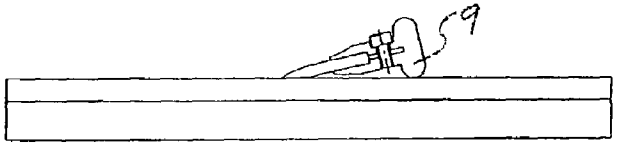
FIG. 2A is a side view of a clamping device according to a second embodiment of the invention, showing the knife blade in a clamped state.
Figure 2B:
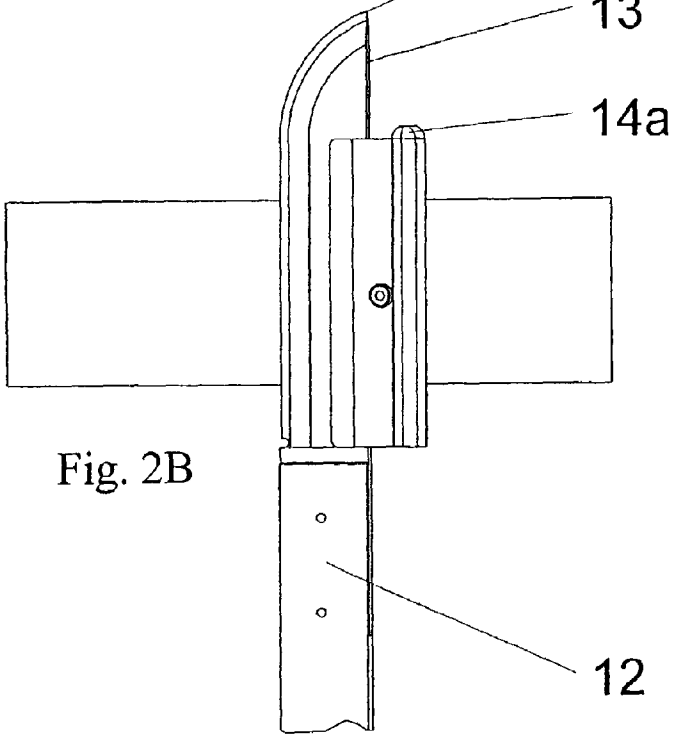
FIG. 2B is a top view of the clamping device according to the second embodiment of the invention, showing the knife in a clamped state.
Figures 3A, 3B, 3C, 3D:
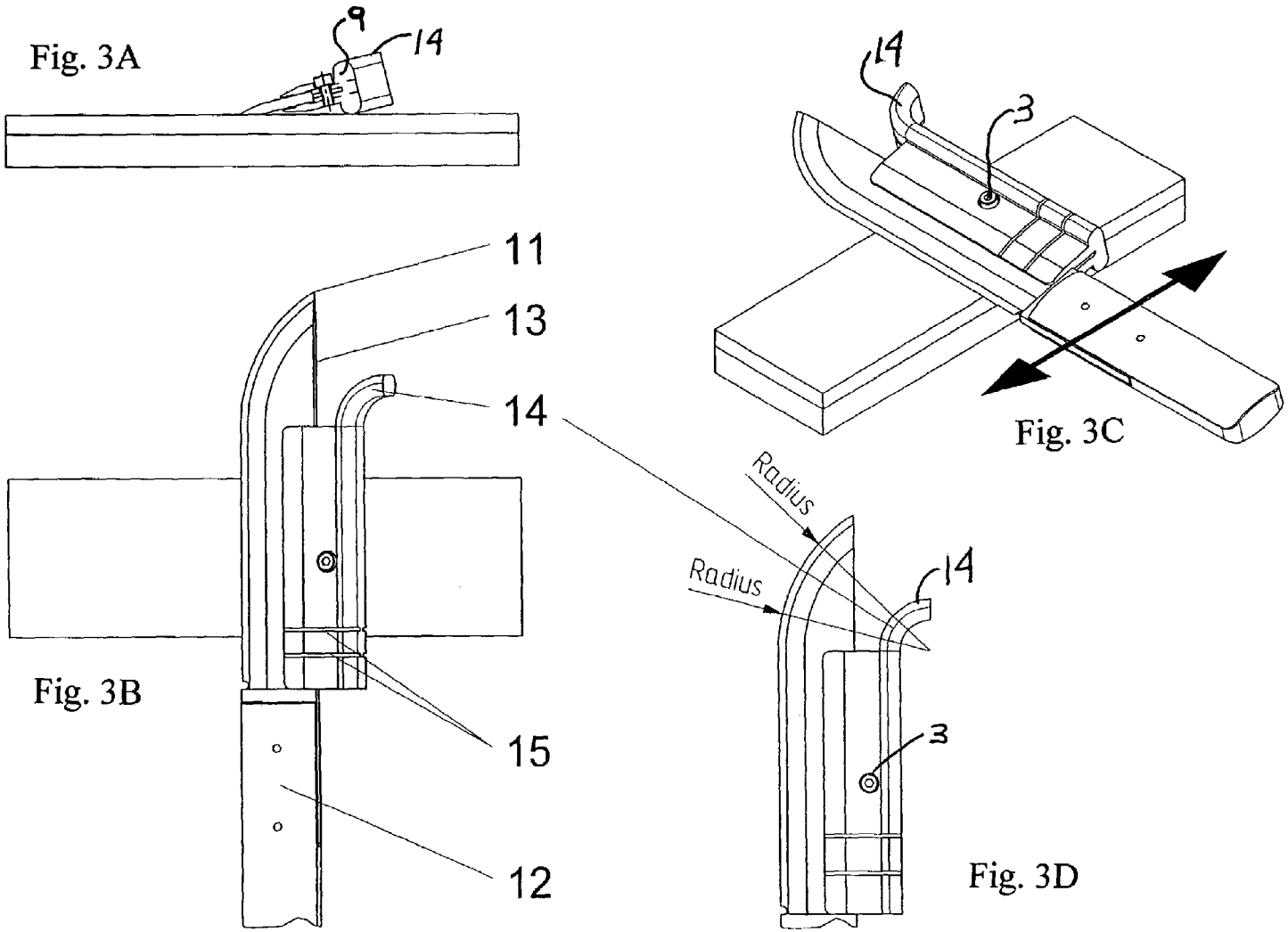
FIG. 3A is a side view of a clamping device according to a third embodiment of the invention, showing the knife blade in a clamped state.
FIG. 3B is a top view of the clamping device according to the third embodiment of the invention, showing the knife in a clamped state.
FIG. 3C is a top right perspective view of the clamping device according to the third embodiment of the invention, showing the knife in a clamped state.
FIG. 3D is a top view of the clamping device according to the third embodiment of the invention, showing the knife in a clamped state and showing the relationship between radius of the knife and end piece provided with an arch.
Figure 4C:
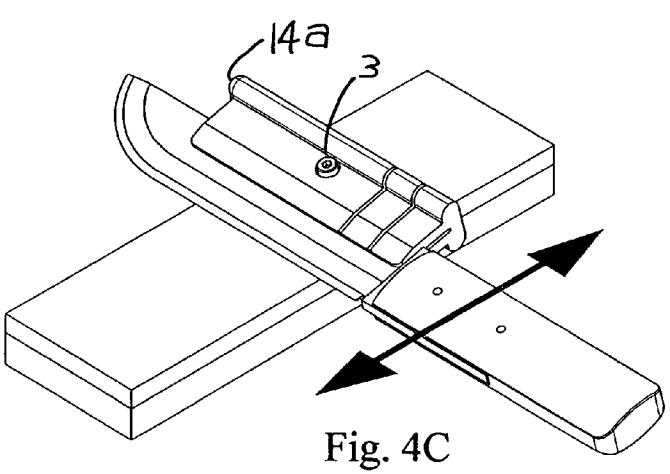
FIG. 4C is a top right perspective view of the clamping device according to the fourth embodiment of the invention, showing the knife in a clamped state.
Figure 4D:
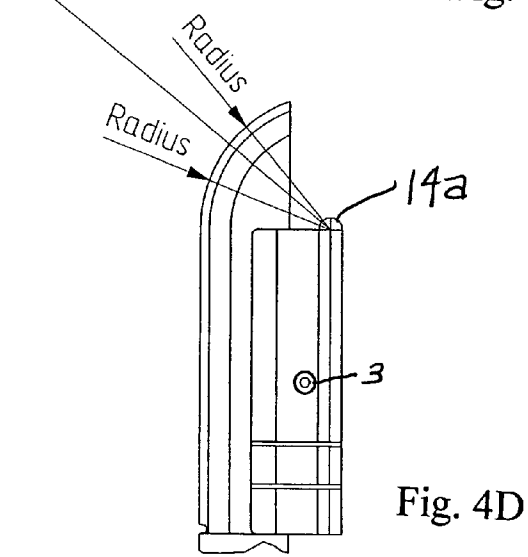
FIG. 4D is a top view of the clamping device according to the s fourth embodiment of the invention, showing the knife in a clamped state and showing the relationship between radius of the knife and end piece provided with a radius.
Figure 4A:
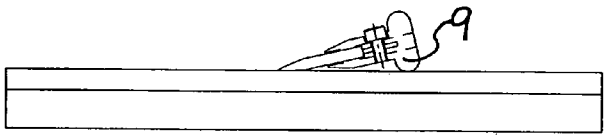
FIG. 4A is a side view of a clamping device according to a fourth embodiment of the invention, showing the knife blade in a clamped state.
Figure 4B:
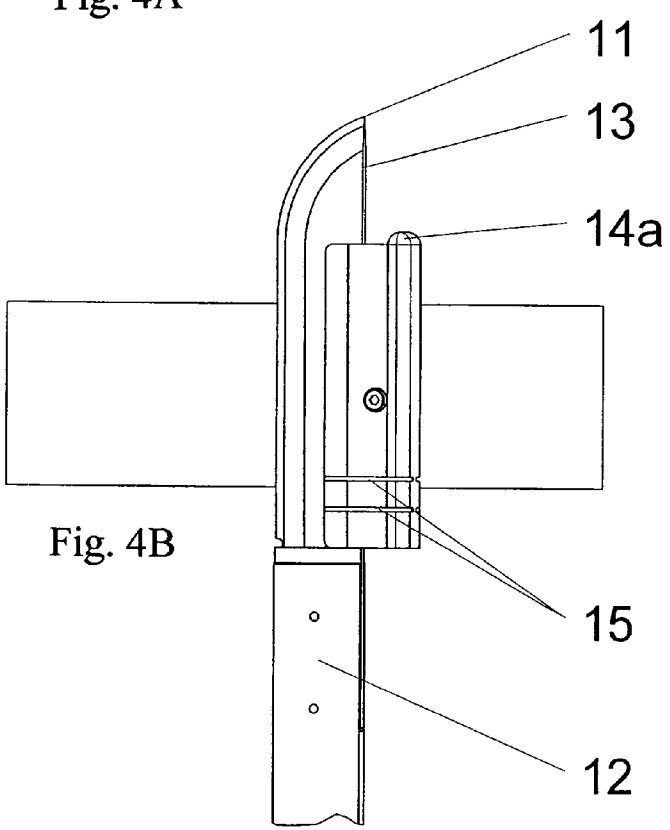
FIG. 4B is a top view of the clamping device according to the fourth embodiment of the invention, showing the knife in a clamped state.

Referring to the drawings in particular, the clamping device 9 shown in the figures comprises a one-part component. This is manufactured from a wear-resistant, elastic plastic, the knife blade 6 being held clampingly between the parallel brackets 4. The two brackets 4 extend in parallel to the knife blade 6 over the entire clamping surface and are in contact with same. Clamping may be brought about by means of a clamping screw 3. The clamping screw 3 contracts the groove 8 and consequently also the brackets 4 on the knife blade and thus ensures firm clamping of the knife blade 6.

However, the clamping of the knife blade 6 may also be carried out by the distance between the two brackets 4 being smaller than the thickness of the knife blade 6. The clamping device 9 is pushed for clamping from the tip 11 of the knife blade onto the knife blade 6 up to a point located at a short distance in front of the knife shaft 12.

It is especially important during the sharpening of knife blades that the setting angle 7 be constant over the entire length of the cutting edge. The back 13 of the knife blade must therefore be in contact with the contact edge 10 in case of the above-mentioned two types 10, of clamping, i.e., in case of clamping by means of a clamping screw 3 or by clamping based on the distance of the brackets, in order to obtain a constant cutting angle.

Figure 5:
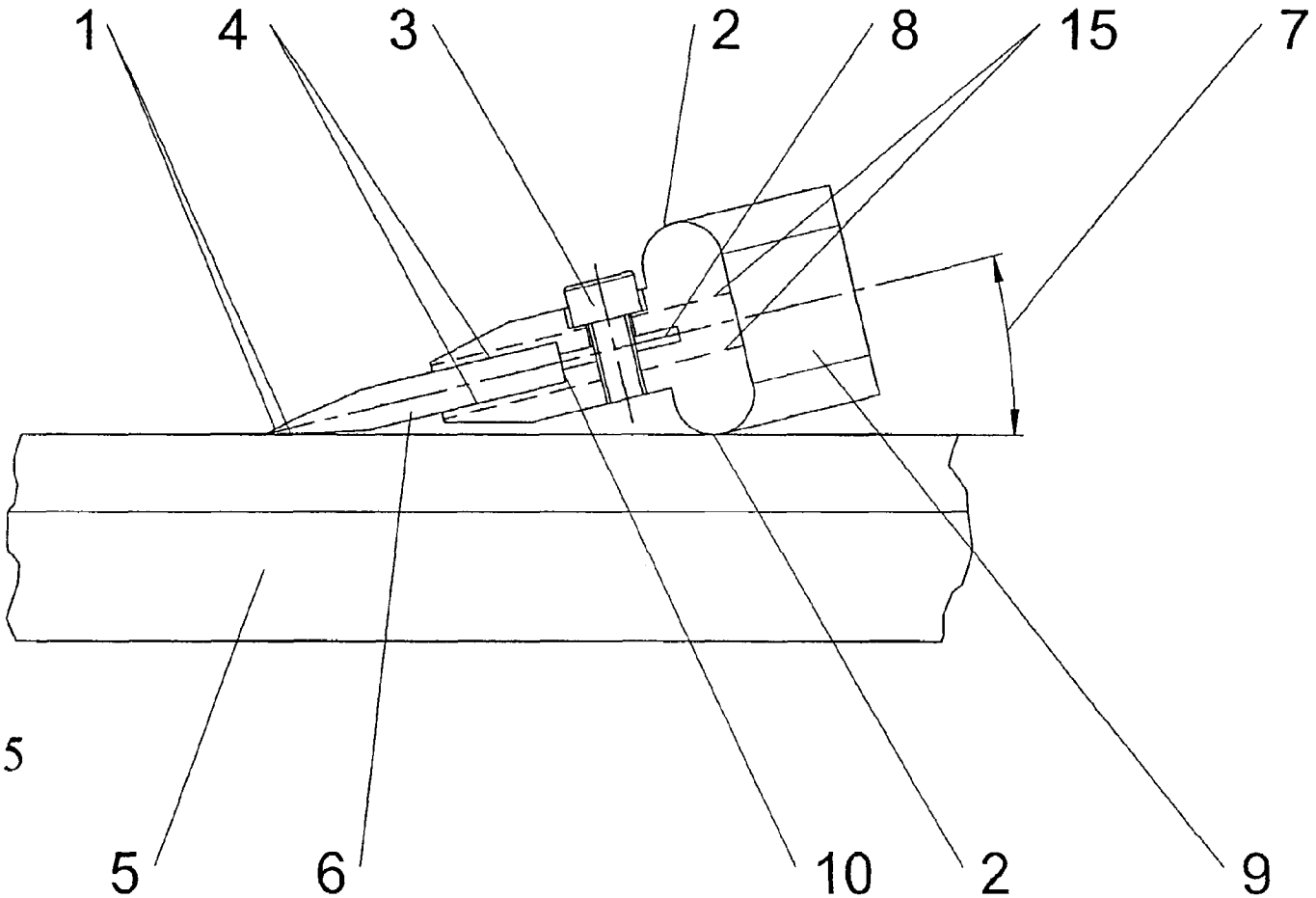
FIG. 5 is an enlarged side sectional view showing the clamping device according to either the first, second, third or fourth embodiment of the invention

The groove 8 ensures that the two brackets 4 can perform elastic movement away from one another in order to make it possible to push over the clamping device and to clamp the knife blade 6. The contour of the surfaces 2, with which the clamping device 9 is guided along at the whetstone 5 during sharpening, is preset by the setting angle 7 or the cutting angle of the knife (FIG. 5). The support contour 14 present at the clamping device 9 is designed such that it is equidistant to the contour of the knife blade. The support contour 14 may be designed with an end piece arch (FIGS. 1A, 1B, 1C and 1D). As an alternative, the support contour 14*a* may have an end piece or end portion with curvature having a radius (FIGS. 2A, 2B, 2C and 2D). The part or portion with arch of the support contour 14 or an end piece or end portion provided with a radius (curvature) may be integral with the remaining support contour 14 or 14*a*. The arch of end piece 14 or of radius 14*a* is the same here as the contour of the knife, which makes possible, in particular, sharpening up to the tip of the knife, i.e., also the resharpening of curved knife blade sections.

Once the clamping device 9 is on the knife blade 6, the clamping device 6 with the knife can be placed on the flat whetstone 5 and sharpened by back and forth movements along the whetstone 5. The clamping device is designed such that the two cutting surfaces 1 of the knife can be sharpened mutually, without requiring reclamping, by simply rotating the knife.

The length, width, height and shape of the clamping device 9 depend on the type of the blade and the blade contour of the knife as well as on the cutting angle of the cutting surfaces 1 that is to be obtained or that is preset by the knife.

The clamping portions (parallel brackets) 4 of the clamping device 9 can be shortened for adaptation to the length of the knife blade. FIG. 3A, 3B, 3C and 3D show an embodiment that is the same as the embodiment of FIG. 1A–D except the clamping device 9 has a plurality of separable areas with reduced cross section to define predetermined breaking points 15. These separable areas allow for a shortening of the clamping device 9 by removing one or more of the separable areas at the predetermined breaking points 15. This allows the clamping device 9 to be dimensioned for use with a shorter knife blade 6.

The clamping portions (parallel brackets) 4 of the clamping device 9 of the embodiment of FIG. 2A–D can also be adapted to be shortened for adaptation to the length of the knife blade. FIG. 4A, 4B, 4C and 4D show an embodiment that is the same as the embodiment of FIG. 2A–D except the clamping device 9 has a plurality of separable areas with reduced cross section to define predetermined breaking points 15. These separable areas allow for a shortening of the clamping device 9 by removing one or more of the separable areas at the predetermined breaking points 15. This allows the clamping device 9 to be dimensioned for use with a shorter knife blade 6.

One advantage of the clamping device is its simple design. Furthermore, it is advantageous that the setting angle 7 in relation to the flat whetstone 5 remains unaffected during the sharpening of the knife 6 by the fact that a clamping device is removed and then replaced.

While specific embodiments of the invention have been shown and described in detail to illustrate the application of the principles of the invention, it will be understood that the invention may be embodied otherwise without departing from such principles.

APPENDIX

List of Reference Numbers

1 Cutting surfaces
2 Support contour (line/surface/point)
3 Clamping screw
4 Bracket
5 Whetstone
6 Knife blade
7 Setting angle
8 Groove
9 Clamping device
10 Contact edge for back of knife
11 Tip of knife blade
12 Back of knife blade
14 Support contour
14*a* Support contour
15 Predetermined breaking points

What is claimed is:

1. A clamping device for the exact manual resharpening of a knife blade on a whetstone, the clamping device comprising:

clamping portions between which the knife blade is received, said clamping portions being movable relative to each other to clamp the received knife therebetween;

a support contour connected to said clamping portions, said support contour having a linear portion being congruent with the contour of the cutting edge of the knife blade in a clamped position between said clamping portions and extending equidistantly from the cutting edge contour of the knife blade and including an end portion provided with an arch or a end portion provided with a radius.

2. A clamping device in accordance with claim 1, wherein said clamping portions comprise two brackets for the clamping support of the knife blade.

3. A clamping device in accordance with claim 2, wherein said brackets cooperate to define a knife blade support contour with a U-shaped cross section for inserting the knife blade.

4. A clamping device in accordance with claim 3, wherein a back edge of knife blade is inserted into the clamping device to a base contact edge of said U-shaped knife blade support contour.

5. A clamping device in accordance with claim 2, further comprising a screw connection, wherein a clamping action of the brackets is supported or can be achieved by said screw connection passing through same.

6. A clamping device in accordance with claim 1, wherein said clamping portions are formed in one piece of a plastic.

7. A clamping device in accordance with claim 6, wherein said plastic is elastic.

8. A clamping device in accordance with claim 1, wherein said clamping portions can be shortened for adaptation to the length of the knife blade.

9. A clamping device in accordance with claim 8, wherein the clamping device has a plurality of separable areas with reduced cross section to define predetermined breaking points.

10. A clamp and sharpening guide device for the exact manual resharpening of a knife blade on a whetstone, the knife blade having a straight portion cutting edge contour and a curved end cutting edge contour, the device comprising:

clamping portions defining an intermediate region between which the knife blade is received and clamped into a fixed position relative to the device; and a support contour connected in a fixed disposition relative to said clamping portions, said support contour including a straight portion disposed adjacent to said clamping portions and extending equidistantly from the straight portion cutting edge contour of the knife blade in a clamped position of said knife blade between said clamping portions and including a curved portion extending equidistantly from the curved portion cutting edge contour of the knife blade with the knife blade in another clamped position between said clamping portions.

11. A clamping device in accordance with claim 10, wherein said clamping portions comprise a first bracket part and a second bracket part extending from said support contour.

12. A clamping device in accordance with claim 11, wherein said bracket parts cooperate to define a U-shaped cross section for inserting the knife blade between said bracket parts.

13. A clamping device in accordance with claim 12, wherein a back edge of knife blade is inserted into the clamping device to a base contact edge of said U-shaped cross section.

14. A clamping device in accordance with claim 11, further comprising a screw connection, wherein a clamping action of the brackets is provided by adjusting a position of a screw of said connection passing through said brackets.

15. A clamping device in accordance with claim 10, wherein said clamping portions and said support contour are formed in one piece of a plastic.

16. A clamping device in accordance with claim 15, wherein said plastic is elastic.

17. A clamping device in accordance with claim 10, wherein said clamping portions can be shortened for adaptation to the length of the knife blade.

18. A clamping device in accordance with claim 17, wherein the clamping device has a plurality of separable areas with reduced cross section to define predetermined breaking points.

19. A clamping device for the exact manual resharpening of a knife blade on a whetstone, the clamping device comprising:

clamping portions between which the knife blade is received;

a support contour connected to said clamping portions, said support contour being congruent with the contour of the cutting edge of the knife blade in a clamped position between said clamping portions and extending equidistantly from the cutting edge contour of the knife blade and including an end portion provided with an arch or a end portion provided with a radius, said support contour and said clamping portions having a plurality of separable areas with reduced cross section to define predetermined breaking points.

* * * * *

UNITED STATES PATENT AND TRADEMARK OFFICE

CERTIFICATE OF CORRECTION

PATENT NO. : 7,182,678 B2
APPLICATION NO. : 11/334720
DATED : February 27, 2007
INVENTOR(S) : Wojtek Keska It is certified that error appears in the above-identified patent and that said Letters Patent is hereby corrected as shown below:

On the title page, item [75]:
The name of the inventor should read as follows:

--Wojtek KESKA--

Signed and Sealed this

Twenty-second Day of May, 2007

JON W. DUDAS
*Director of the United States Patent and Trademark Office*